US011486414B2

(12) United States Patent
Zhang et al.

(10) Patent No.: US 11,486,414 B2
(45) Date of Patent: Nov. 1, 2022

(54) FAN AND ELECTROMECHANICAL APPARATUS

(71) Applicant: Nidec Corporation, Kyoto (JP)

(72) Inventors: Tiecheng Zhang, Kyoto (JP); Xuechao Zhang, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 0 days.

(21) Appl. No.: 16/904,620

(22) Filed: Jun. 18, 2020

(65) Prior Publication Data

US 2020/0408216 A1 Dec. 31, 2020

(30) Foreign Application Priority Data

Jun. 28, 2019 (CN) ..... 201910571570.9

(51) Int. Cl.

| | |
|---|---|
| ***F04D 25/06*** | (2006.01) |
| ***F04D 17/16*** | (2006.01) |
| ***F04D 29/42*** | (2006.01) |
| ***F04D 29/44*** | (2006.01) |

(52) U.S. Cl.

CPC ..... *F04D 29/4293* (2013.01); *F04D 17/16* (2013.01); *F04D 25/06* (2013.01); *F04D 29/444* (2013.01); *F05B 2240/14* (2013.01); *F05D 2250/51* (2013.01)

(58) Field of Classification Search

CPC ..... F04D 25/0613; F04D 25/06; F04D 25/08; F04D 29/4226; F04D 29/544; F04D 17/162; F04D 27/002; F04D 29/4213; F04D 29/444; F04D 29/522; F04D 29/646

See application file for complete search history.

(56) References Cited

U.S. PATENT DOCUMENTS 5,772,399 A * 6/1998 Mehta ..... F04D 27/00 415/148
6,652,246 B1 * 11/2003 Lin ..... F04D 25/0613 417/360
8,137,064 B2 * 3/2012 Takemoto ..... F04D 29/544 415/211.2

(Continued)

FOREIGN PATENT DOCUMENTS

CN 206723100 U 12/2017
JP 2011-252426 A 12/2011

OTHER PUBLICATIONS

Official Communication issued in corresponding Chinese Patent Application No. 201910571570.9, dated Jun. 16, 2022.

*Primary Examiner* — Dominick L Plakkoottam
(74) *Attorney, Agent, or Firm* — Keating & Bennett

(57) ABSTRACT

A fan includes an impeller rotating on a central axis, an impeller housing, a motor located on one side in an axial direction of the impeller and driving the impeller to rotate, and a motor housing. The impeller housing is provided with an air inlet. The fan further includes a pre-pressing portion expanding radially inward from an edge of the air inlet. The pre-pressing portion includes a pressing portion located on another side in the axial direction of the impeller and pressing, from the another side in the axial direction, an end portion of the impeller on the another side in the axial direction, and at least two connection portions connected between an outer periphery of the pressing portion and the edge of the air inlet. The connection portions are disposed obliquely with respect to the axial direction.

10 Claims, 6 Drawing Sheets

(56) References Cited

U.S. PATENT DOCUMENTS

| | | | | |
|---|---|---|---|---|
| 9,322,413 | B2 * | 4/2016 | Lin | F04D 25/08 |
| 2010/0329886 | A1 | 12/2010 | Sung et al. | |
| 2011/0135464 | A1 * | 6/2011 | Luo | F04D 29/646 415/230 |
| 2012/0121407 | A1 * | 5/2012 | Yamashita | F04D 17/162 415/213.1 |
| 2018/0128286 | A1 * | 5/2018 | Schafer | F04D 29/544 |

* cited by examiner

FAN AND ELECTROMECHANICAL APPARATUS

CROSS REFERENCE TO RELATED APPLICATION

The present application claims priority under 35 U.S.C. § 119 to Chinese Application No. 201910571570.9 filed Jun. 28, 2019, the entire contents of which are hereby incorporated herein by reference.

1. FIELD OF THE INVENTION

The present disclosure relates to a fan and an electromechanical apparatus.

2. BACKGROUND

Fans are widely used in home appliances, office automation equipment, etc. to promote air flow.

Common fans are divided into axial fans and centrifugal fans. In an axial fan, air flows in the axial direction of the blades. In a centrifugal fan, air is sucked into the impeller in the axial direction and then flows out in the circumferential direction.

Compared to axial fans, centrifugal fans take up less space and have a larger air output. For example, centrifugal fans may be used in vacuum cleaners, robot vacuum cleaners, and other apparatuses.

During the operation of the centrifugal fan, especially at a high speed, the impeller is likely to move in the axial direction, which causes friction with the impeller housing and reduces the service life of the centrifugal fan. For example, in the case where the rotation axis of the impeller is configured in an up-down direction, when the air is sucked into the impeller via the air inlet, the air applies an upward force in the axial direction to the impeller. If the force exceeds the gravity of the impeller, the impeller will be in a lifted state, which will cause friction with the impeller housing. Without changing the motor efficiency and the blade shape, in order to control the axial movement of the impeller, it would be necessary to control the rotation speed of the impeller. As a result, it is difficult to improve the air suction efficiency of the fan.

Generally, a magnetic device may be used to suppress the axial movement of the impeller, or a snap ring may be disposed in the outer periphery of the rotation axis to suppress the axial movement of the impeller.

It should be noted that the above description of the technical background is merely intended to facilitate a clear and complete description of the technical solution of the disclosure and facilitate the understanding for those skilled in the art. The above technical solutions should not be considered to be well-known to those skilled in the art simply because these solutions are described in the background section of the disclosure.

The inventors of the present disclosure have discovered that there are some limitations to the existing solutions of suppressing the axial movement of the impeller. For example, in the solution of using a magnetic device, a large magnetic force is required to effectively suppress the movement of the impeller, so the implementability is low and the cost is high. In the solution of disposing a snap ring, since the snap ring is not of a wear-resistant material, it will affect the rotation of the impeller. Moreover, the mechanical strength of the snap ring is low, so the snap ring cannot support the rotation of the rotation axis for a long time and it is likely to be damaged and lose the limitation effect in the axial direction.

SUMMARY

A fan of an example embodiment of the present disclosure includes an impeller capable of rotating on a central axis, an impeller housing receiving the impeller, a motor located on one side in an axial direction of the impeller and driving the impeller to rotate, and a motor housing located in an outer periphery of the motor and receiving the motor. The impeller housing is provided with an air inlet at a central portion. The fan further includes a pre-pressing portion expanding radially inward from an edge of the air inlet. The pre-pressing portion includes a pressing portion located on another side in the axial direction of the impeller and pressing, from the another side in the axial direction, an end portion of the impeller on the another side in the axial direction, and at least two connection portions connected between an outer periphery of the pressing portion and the edge of the air inlet, where the connection portions are positioned obliquely with respect to the axial direction.

The above and other elements, features, steps, characteristics and advantages of the present disclosure will become more apparent from the following detailed description of the example embodiments with reference to the attached drawings.

DETAILED DESCRIPTION

Figure 1:
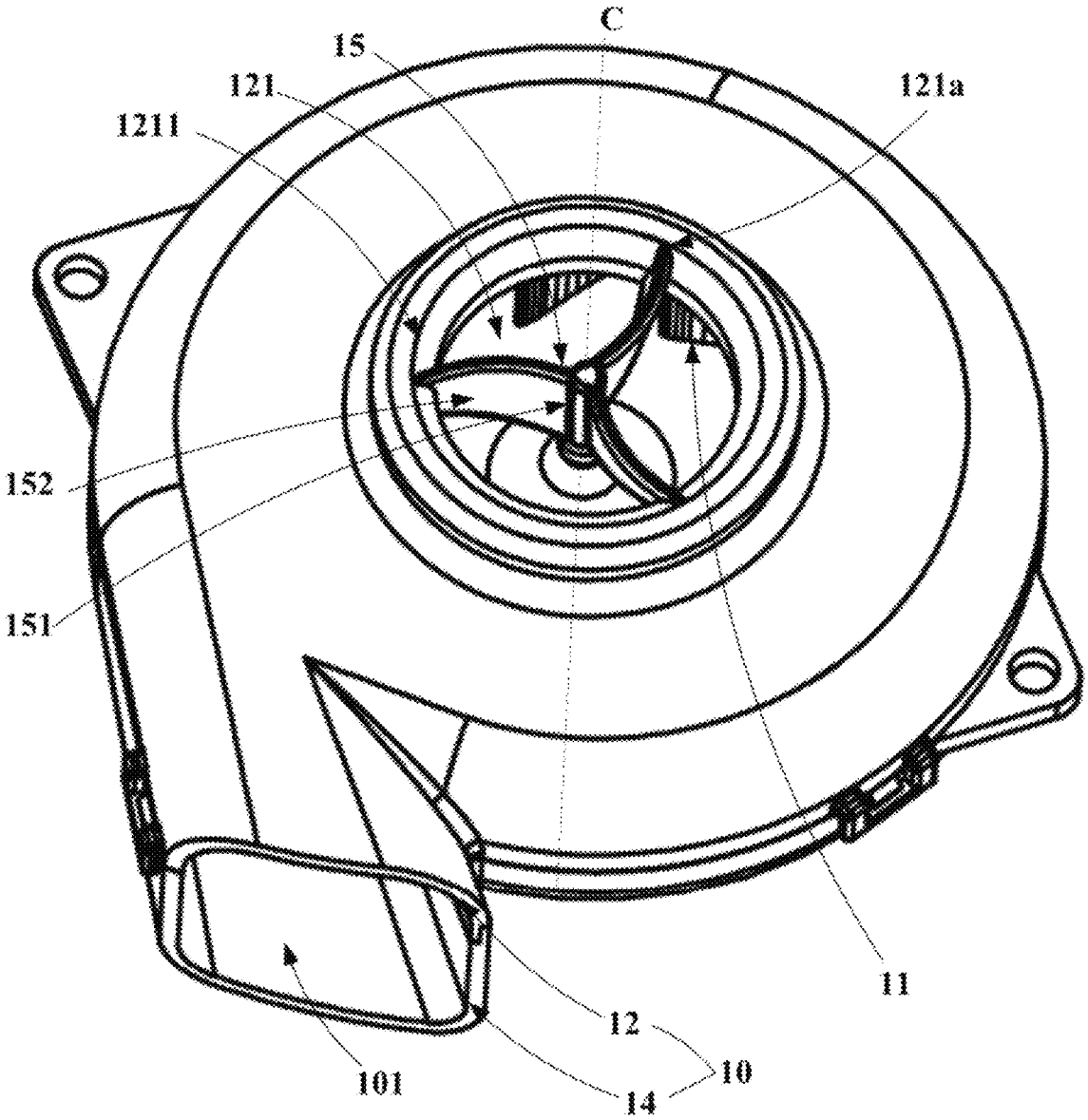
FIG. 1 is a schematic perspective view showing a fan of a first example embodiment of the present disclosure.

The foregoing and other features of the disclosure will become apparent from the following description with reference to the accompanying drawings. In the description and the drawings, some example embodiments of the disclosure are specifically disclosed to show part of the example embodiments in which the principles of the disclosure may be adopted. It should be understood that the disclosure is not limited to the described example embodiments but includes all modifications, variations, and equivalents that fall within the scope of the appended claims.

In the example embodiments of the disclosure, the terms "first", "second", etc. are used to distinguish among different elements by their names, but they do not indicate the spatial arrangement, time sequence, etc. of these elements, and these elements should not be limited by these terms. The term "and/or" includes any and all combinations of one or more of the associated listed terms. The terms "comprising", "including", "having", etc. refer to the presence of the stated features, elements, devices, or components, but do not exclude the presence or addition of one or more other features, elements, devices, or components.

In the example embodiments of the disclosure, the singular forms "a", "the", etc. include the plural forms and should be construed broadly as "one type" or "one class" rather than limited to the meaning of "one single". Furthermore, the term "the" should be understood to include both the singular forms and the plural forms, unless the context clearly indicates otherwise. In addition, the term "according to . . . " should be understood as "at least partially according to . . . " and the term "based on" should be understood as "at least partially based on . . . ", unless the context clearly indicates otherwise.

Moreover, in the following description of the example embodiments of the disclosure, for convenience of illustration, a direction in which the central axis of the impeller extends is referred to as the "axial direction". In the "axial direction", a direction from the air inlet of the impeller housing toward the impeller becomes the "down" direction, and a direction opposite to the "down" direction is the "up" direction. A radius direction with the central axis as the center is referred to as the "radial direction". A direction surrounding the central axis is referred to as the "circumferential direction". The above description of the directions is only meant for convenience of illustration and is not used to limit the direction during manufacturing and use of the centrifugal fan of the disclosure.

In addition, in the example embodiments of the disclosure, although an "air inlet" and an "air outlet" are recited, the centrifugal fan of the example embodiments of the disclosure is not limited to the application scenario in which air is flowed, and other fluids such as liquids may also flow into the casing via the "air inlet" and flow out of the casing via the "air outlet".

A first example embodiment of the disclosure provides a fan.

Figure 2:
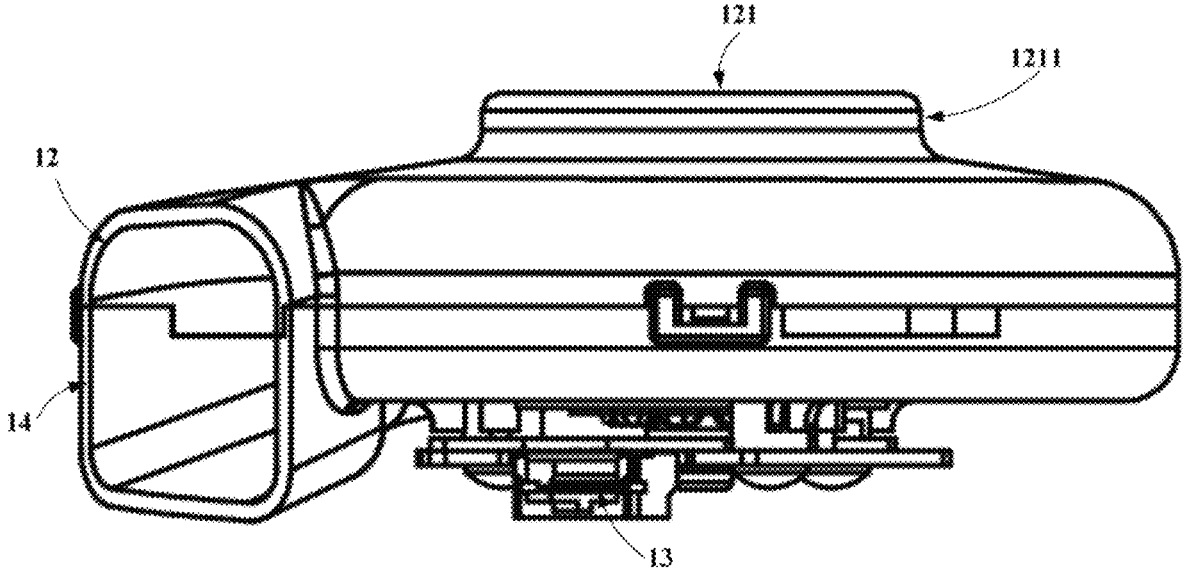
FIG. 2 is a schematic view showing the fan of the first example embodiment of the present disclosure when viewed from a lateral side.
Figure 3:
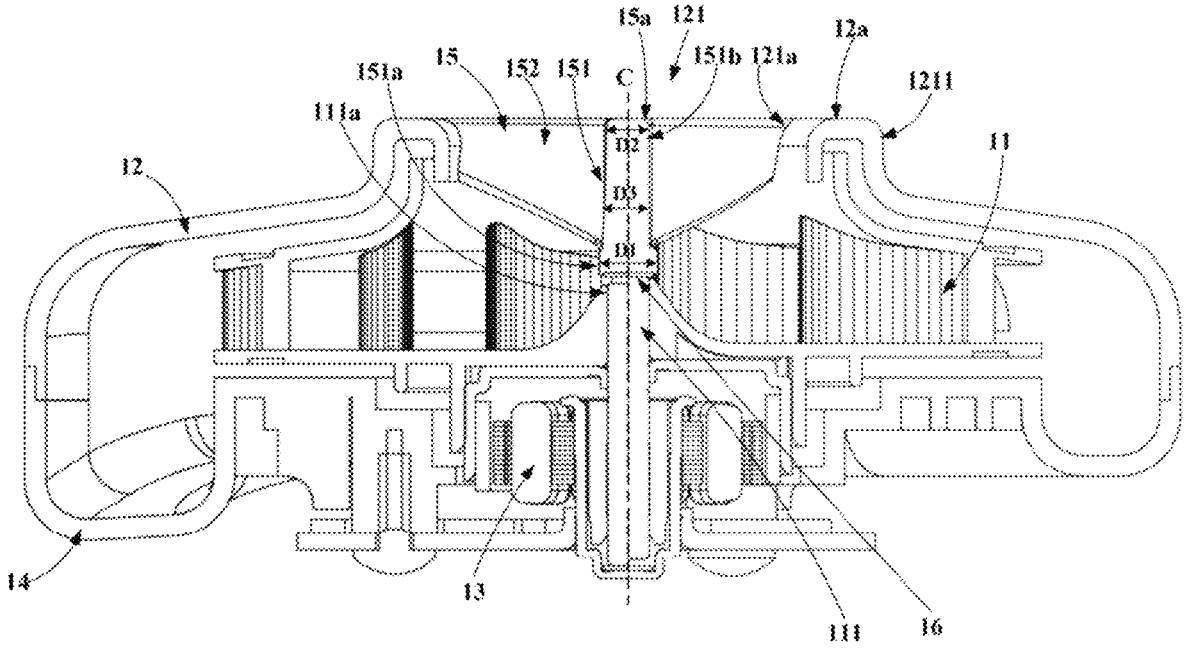
FIG. 3 is a schematic axial sectional view of FIG. 1.

FIG. 1 is a schematic perspective view showing the fan of the first example embodiment of the disclosure when viewed from an upper side. FIG. 2 is a schematic view showing the fan of the first example embodiment of the disclosure when viewed from a lateral side. FIG. 3 is a schematic axial sectional view of FIG. 1. The left half region (left side of a central axis C) of FIG. 3 shows the case where the impeller does not move upward in the axial direction, and the right half region (right side of the central axis C) of FIG. 3 shows the case where the impeller moves upward in the axial direction.

As shown in FIG. 1, FIG. 2, and FIG. 3, a fan 1 includes an impeller 11, an impeller housing 12, a motor 13 (shown in FIG. 2 and FIG. 3), and a motor housing 14.

In at least one example embodiment of the disclosure, the impeller 11 may rotate on the central axis C. The motor 13 may be located on one side in the axial direction of the impeller 11. For example, the motor 13 is located on the lower side of the impeller 11. The motor 13 may drive the impeller 11 to rotate. The impeller housing 12 may be located in the outer periphery of the impeller 11 to receive the impeller 11. The motor housing 14 may be located in the outer periphery of the motor 13 to receive the motor 13.

As shown in FIG. 1, FIG. 2, and FIG. 3, an air inlet 121 may be provided in a central portion of the impeller housing 12. Air may enter inside the impeller housing 12 via the air inlet 121. As shown in FIG. 1 and FIG. 2, the air inlet 121 may have a wall part 1211 extending upward in the axial direction. In addition, the example embodiment is not limited thereto, and it is possible that the air inlet 121 does not have the wall part 1211.

As shown in FIG. 1 and FIG. 3, the fan 1 may further include a pre-pressing portion 15. The pre-pressing portion 15 may expand radially inward from an edge 121*a* of the air inlet 121.

As shown in FIG. 1 and FIG. 3, the pre-pressing portion 15 may include a pressing portion 151 and connection portions 152. The pressing portion 151 is located on an axially upper side of the impeller 11 and presses an axially upper end portion of the impeller 11 from the axially upper side. The number of the connection portions 152 is at least two, and each connection portion 152 is connected between an outer periphery of the pressing portion 151 and the edge 121*a* of the air inlet 121.

As shown in the right half region in FIG. 3, in the case where the impeller 11 rotates and thus moves upward by a certain distance in the axial direction, the pressing portion 151 of the pre-pressing portion 15 blocks the rotation axis 111 of the impeller 11 in the axial direction and thereby restricts the distance of the upward movement of the impeller 11.

As shown in FIG. 1, in at least one example embodiment of the disclosure, the connection portions 152 are disposed obliquely with respect to the direction of the central axis C.

According to the first example embodiment of the disclosure, the pre-pressing portion connected to the air inlet is used to press the upper end portion of the impeller to restrict the axial movement of the impeller. In addition, the pre-pressing portion has the connection portions disposed obliquely with respect to the axial direction, which can guide the air flow near the air inlet to prevent the pre-pressing portion from affecting the air suction effect and thereby improve the air suction efficiency.

In at least one example embodiment of the disclosure, when viewed in the axial direction, the pressing portion 151 at least partially overlaps with the rotation axis 111 of the impeller 11, so that the pressing portion 151 can restrict the movement of the rotation axis 111 of the impeller 11 in the axial direction.

For example, as shown in FIG. 3, a lower end portion 151*a* of the pressing portion 151 and an upper end portion 111*a* of the rotation axis 111 of the impeller 11 may be disposed to face each other in the axial direction.

As shown in FIG. 3, a gasket 16 may be provided between the lower end portion 151*a* of the pressing portion 151 and the upper end portion 111*a* of the rotation axis 111 of the impeller 11. Therefore, when the impeller 11 moves upward in the axial direction, the lower end portion 151*a* of the pressing portion 151 and the upper end portion 111*a* of the rotation axis 111 of the impeller 11 can abut via the gasket to avoid affecting the rotation of the impeller. The gasket 16 may include a wear-resistant material to extend the service life of the rotation axis 111 and the pressing portion 151. In addition, in the case where both the lower end portion 151*a* of the pressing portion 151 and the upper end portion 111*a* of the rotation axis 111 of the impeller 11 are coated with a wear-resistant material layer, it is also possible that the gasket 16 is not provided.

In at least one example embodiment of the disclosure, as shown in FIG. 3, a diameter D1 of the axially lower end portion 151*a* of the pressing portion 151 and a diameter D2 of an axially upper end portion 151*b* are both larger than a diameter D3 of an axially middle portion of the pressing portion 151. With the diameter D1 of the lower end portion 151*a* being larger, the strength of the pressing portion 151 can be increased. With the diameter D2 of the upper end portion 151*b* being larger, it is favorable for uniform distribution of the stress at the connection between the connection portions 152 and the pressing portion 151. With the diameter D3 of the axially middle portion of the pressing portion 151 being smaller, the obstruction to the air flow in the air inlet 121 can be reduced.

Figure 4:
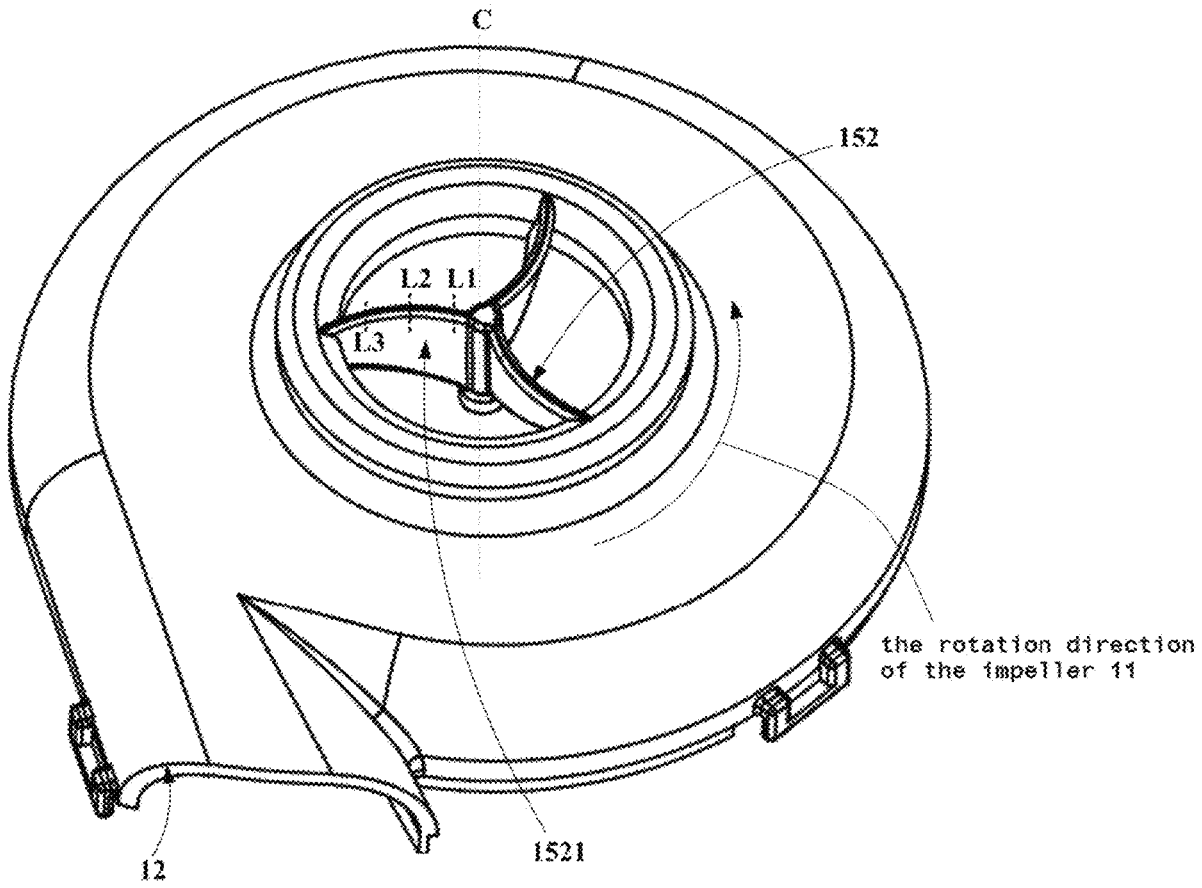
FIG. 4 is a separate schematic view showing an impeller housing and a pre-pressing portion of the first example embodiment of the present disclosure.

FIG. 4 is a separate schematic view showing the impeller housing and the pre-pressing portion. As shown in FIG. 4, a surface 1521 of the connection portion 152 may be disposed obliquely with respect to the extending direction of the central axis C. The surface 1521 of the connection portion 152 may be a curved surface, a flat surface, or a surface composed of a curved surface and a flat surface. Therefore, the air flow near the air inlet 121 can be guided to avoid affecting the air suction amount.

Figure 5:
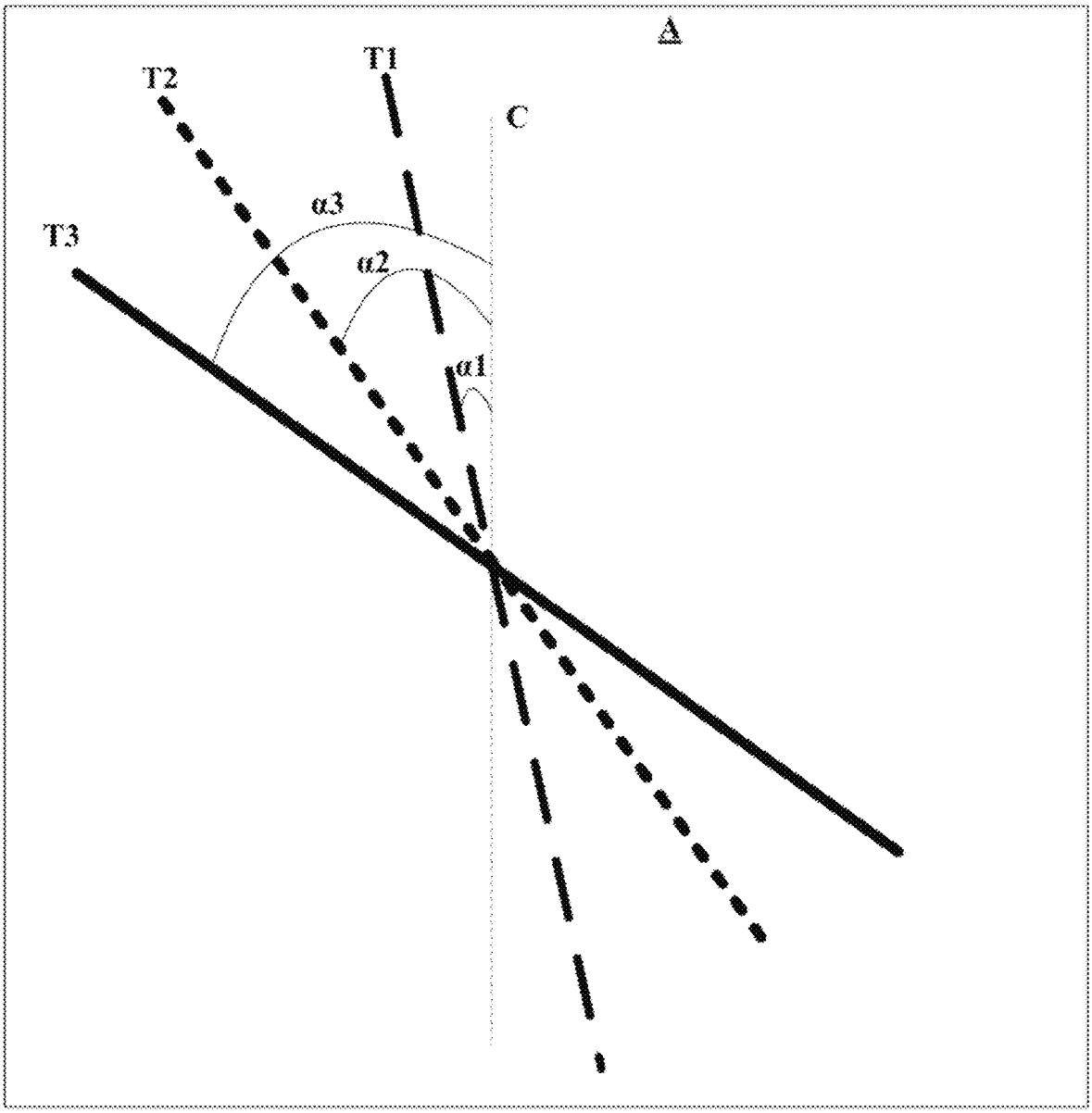
FIG. 5 is a schematic view showing projections of positions of a connection portion distributed in the radial direction on a plane A perpendicular to the radial direction according to the first example embodiment of the present disclosure.

In at least one example embodiment of the disclosure, the connection portion 152 may be formed substantially in the shape of a stationary blade. FIG. 5 is a schematic view showing projections of positions of the connection portion 152 distributed in the radial direction on a plane A perpendicular to the radial direction. As shown in FIG. 4 and FIG. 5, at each position (e.g., positions L1, L2, and L3) of the connection portion 152 distributed in the radial direction, an included angle α (e.g., included angles α1, α2, and α3) between a projection T (e.g., projections T1, T2, and T3) of the connection portion 152 on the plane A (as shown in FIG. 5) perpendicular to the radial direction and the central axis C varies as the distance between the position and the edge 121*a* of the air inlet 121 in the radial direction varies. The included angle α may be regarded as a twist angle of each position of the connection portion 152 distributed in the radial direction with respect to the central axis C.

In at least one example embodiment of the disclosure, within the entire range of variation in the radial direction of the positions of the connection portion 152 distributed in the radial direction, the range of variation of the included angle α between the projection T of the connection portion 152 on the plane A perpendicular to the radial direction and the central axis C is 15 degrees. Namely, the difference between the twist angle at the radially inner end of the connection portion 152 and the twist angle at the radially outer end is 15 degrees. Therefore, the air suction efficiency can be maximized. In addition, with different rotation speeds of the impeller 11, the range of variation of the included angle α may be other angles such as 30 degrees, 45 degrees, etc.

In at least one example embodiment of the disclosure, when the impeller 11 rotates to cause an air flow, the surface of the connection portion 152 can guide the air flow to a front side of the rotation direction of the impeller 11.

Figure 6:
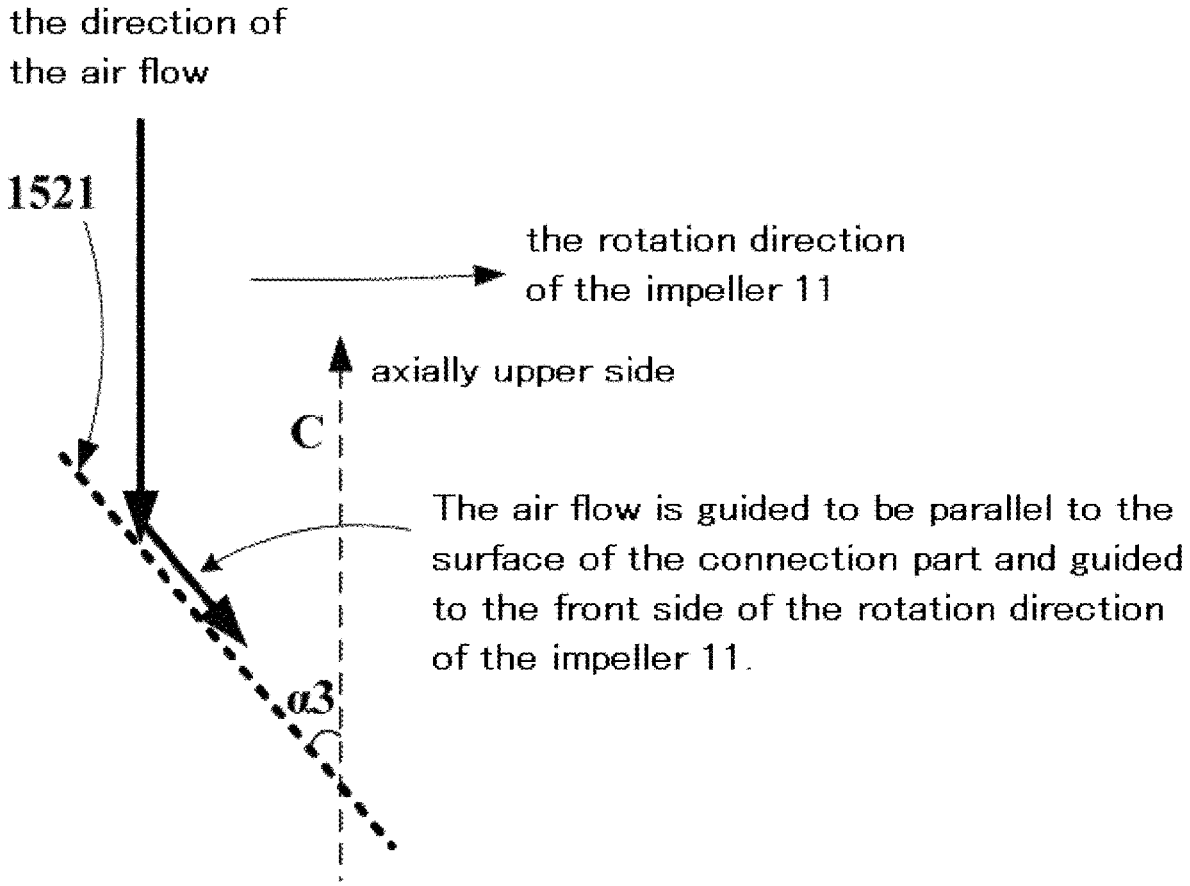
FIG. 6 is a schematic axial sectional view showing the surface of the connection portion at a position L3 in FIG. 4 guiding an air flow.

FIG. 6 is a schematic axial sectional view showing the surface of the connection portion at the position L3 in FIG. 4 guiding the air flow. As shown in FIG. 6, the rotation direction of the impeller 11 is the same as that shown in FIG. 4. At the position L3, the included angle between the surface 1521 of the connection portion 152 and the central axis C is α3, and the surface 1521 faces upward in the axial direction and the rotation direction of the impeller 11. Near the air inlet, the air flows downward in the axial direction and comes into contact with the surface 1521 of the connection portion 152 to be thereby guided by the surface 1521 to be parallel to the surface 1521 of the connection portion 152 and guided to the front side of the rotation direction of the impeller 11.

In at least one example embodiment of the disclosure, the connection portion 152 is oblique with respect to the axial direction. Compared to the case where the connection portion 152 is parallel to the axial direction, the example embodiment of the disclosure can avoid adverse effect caused by the connection portion 152 on the air flow of the air inlet and thus can prevent the reduction in the air suction efficiency.

In at least one example embodiment of the disclosure, the pre-pressing portion 15 and the impeller housing 12 may be integrally formed to thus improve the connection strength of the pre-pressing portion 15 and the impeller housing 12 and reduce costs. In addition, the pre-pressing portion 15 and the impeller housing 12 may also be formed separately, and the two may be connected by a connection member (not shown).

As shown in FIG. 3, in at least one example embodiment of the disclosure, the position of an axially upper end portion 15*a* of the pre-pressing portion 15 may be equal to or lower than the position of an axially upper end portion 12*a* of the impeller housing 12 to thus reduce the influence on the air suction efficiency of the air inlet 121 caused by the pre-pressing portion 15.

As shown in FIG. 1, in at least one example embodiment of the disclosure, the impeller housing 12 and the motor housing 14 may collectively form a casing 10 of the fan 1. The casing 10 may have an air inlet 121 and an air outlet 101. When the motor 13 drives the impeller 11 to rotate, air may enter inside the casing 10 via the air inlet 121 and exit the casing 10 via the air outlet 101.

According to the first example embodiment of the disclosure, the pre-pressing portion connected to the air inlet is used to press the upper end portion of the impeller to restrict the axial movement of the impeller. In addition, the pre-pressing portion has the connection portions which are disposed obliquely with respect to the axial direction and can guide the air flow near the air inlet to prevent the pre-pressing portion from affecting the air suction effect and thereby improve the air suction efficiency.

A second example embodiment of the disclosure provides an electromechanical apparatus having the fan described in the first example embodiment of the disclosure. Since the structure of the fan has been described in detail in the first example embodiment of the disclosure, its content is incorporated herein and its description is omitted herein.

In at least one example embodiment of the disclosure, the electromechanical apparatus may be, for example, a robot vacuum cleaner.

According to the second example embodiment of the disclosure, the pre-pressing portion connected to the air inlet is provided in the fan of the electromechanical apparatus to press the upper end portion of the impeller to thereby restrict the axial movement of the impeller, reduce noise, and increase the service life. In addition, the pre-pressing portion has the connection portions which are disposed obliquely with respect to the axial direction and can guide the air flow near the air inlet to prevent the pre-pressing portion from affecting the air suction effect and thereby improve the air suction efficiency. Therefore, the noise generated during the operation of the electromechanical apparatus is reduced, the service life is extended, and the efficiency is improved.

Although the disclosure has been described above with reference to the specific example embodiments, it should be clear to those skilled in the art that these descriptions are exemplary and do not limit the protection scope of the disclosure. Those skilled in the art may make various modifications and changes to the disclosure according to the spirit and principles of the disclosure, and these modifications and changes also fall within the scope of the disclosure.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A fan comprising:

an impeller capable of rotating on a rotation axis;

an impeller housing receiving the impeller;

a motor located on one side in an axial direction of the impeller and driving the impeller to rotate; and a motor housing located in an outer periphery of the motor and accommodating the motor; wherein the impeller housing is provided with an air inlet at a central portion;

the fan further includes a pre-pressing portion expanding radially inward from an edge of the air inlet;

the pre-pressing portion includes:

a pressing portion located on another side in the axial direction of the impeller and pressing, from the another side in the axial direction, an end portion of the rotation axis on the another side in the axial direction; and at least two connection portions connected between an outer periphery of the pressing portion and the edge of the air inlet;

the connection portions are disposed obliquely with respect to the axial direction; and a diameter of an end portion of the pressing portion on the another side in the axial direction and a diameter of an end portion of the pressing portion on the one side in the axial direction are both larger than a diameter of an axially middle portion of the pressing portion.

2. The fan according to claim 1, wherein at each position distributed in a radial direction, an included angle between a projection of the connection portions on a plane perpendicular to the radial direction and the axial direction varies as a distance in the radial direction between the position and the edge of the air inlet varies.

3. The fan according to claim 2, wherein within an entire range of variation of the position in the radial direction, a range of variation of the included angle between the projection of the connection portions on the plane perpendicular to the radial direction and the axial direction is 15 degrees.

4. The fan according to claim 1, wherein when the impeller rotates to cause an air flow, a surface of the connection portions guides the air flow to a front side of a rotation direction of the impeller.

5. The fan according to claim 4, wherein the surface of the connection portions opposing the another side in the axial direction opposes the rotation direction of the impeller.

6. The fan according to claim 1, wherein the pre-pressing portion and the impeller housing are integrally defined by a single monolithic member.

7. The fan according to claim 1, wherein a position of an end portion of the pre-pressing portion on the another side in the axial direction is equal to or lower than a position of an end portion of the impeller housing on the another side in the axial direction.

8. The fan according to claim 1, wherein a gasket is provided between an end portion of the pre-pressing portion on the one side in the axial direction and an end portion of the rotation axis on the another side in the axial direction.

9. An electromechanical apparatus, comprising the fan according to claim 1.

10. A fan, comprising:

an impeller capable of rotating on a rotation axis;

an impeller housing receiving the impeller;

a motor located on one side in an axial direction of the impeller and driving the impeller to rotate; and a motor housing located in an outer periphery of the motor and accommodating the motor; wherein the impeller housing is provided with an air inlet at a central portion;

the fan further includes a pre-pressing portion expanding radially inward from an edge of the air inlet;

the pre-pressing portion includes:

a pressing portion located on another side in the axial direction of the impeller and pressing, from the another side in the axial direction, an end portion of the rotation axis on the another side in the axial direction; and at least two connection portions connected between an outer periphery of the pressing portion and the edge of the sir inlet;

the connection portions are disposed obliquely with respect to the axial direction;

an end portion of the pressing portion on the one side in the axial direction and an end portion of a rotation axis of the impeller on the another side in the axial direction oppose each other in the axial direction; and all portions of the pre-pressing portion are located in a space axially above or axially below all portions of the rotation axis of the impeller.

* * * * *